United States Patent [19]

Magnien et al.

[11] Patent Number: 4,748,728

[45] Date of Patent: Jun. 7, 1988

[54] PROCESSES FOR THE MECHANIZED MANUFACTURE OF JEWELRY COMPRISING A PLURALITY OF SMALL CONTIGUOUS STONES SET IN A SUPPORT MADE OF PRECIOUS METAL JEWELRY

[75] Inventors: Emile G. Magnien; Alain M. Plantureux, both of Montpellier, France

[73] Assignee: Diamant Applications, Montpellier, France

[21] Appl. No.: 911,741

[22] Filed: Sep. 26, 1986

[51] Int. Cl.[4] ..... B23P 5/00

[52] U.S. Cl. ..... 29/10; 63/28

[58] Field of Search ..... 29/160.6, 10; 63/26, 63/28

[56] References Cited

U.S. PATENT DOCUMENTS

| | | | |
|---|---|---|---|
| 1,604,013 | 10/1926 | Bausch | 63/26 |
| 4,400,932 | 8/1983 | Epstein | 63/28 |

FOREIGN PATENT DOCUMENTS

| | | | |
|---|---|---|---|
| 089906 | 9/1983 | European Pat. Off. . | |
| 3342021 | 5/1985 | Fed. Rep. of Germany | 63/26 |
| 363959 | 10/1906 | France . | |
| 837495 | 2/1939 | France . | |
| 2524779 | 10/1983 | France | 63/26 |
| 124436 | 11/1984 | France | 29/10 |

*Primary Examiner*—P. W. Echols

*Attorney, Agent, or Firm*—Balogh, Osann, Kramer, Dvorak, Genova & Traub

[57] ABSTRACT

Process for manufacturing jewelry comprising the steps of mounting a metallic mounting on a movable table of a machine-tool, machining in the mounting a plurality of contiguous cylindrico-conical bores comprising a conical seating, machining in the outer periphery of each conical seating a triangular groove, machining the metallic mounting with a rotating tool for removing a part of the metal bridges between said contiguous bores and leaving a few islets of metal which constitute claws, placing a little stone in each bore, pushing down the upper faces of the stones with a push-member until the lower face of said push-member is applied against the upper faces of all the stones and pressing a setting tool over the claws to set the stones.

6 Claims, 2 Drawing Sheets

PROCESSES FOR THE MECHANIZED MANUFACTURE OF JEWELRY COMPRISING A PLURALITY OF SMALL CONTIGUOUS STONES SET IN A SUPPORT MADE OF PRECIOUS METAL JEWELRY

The present invention relates to processes for the mechanized manufacture of jewelry comprising a plurality of small contiguous stones set in a support made of precious metal and the jewelry obtained by these processes. The technical sector of the invention is that of the manufacture of jewelry.

The use of numerical-control machine-tools permits the machining, in supports made of precious metal such as gold, of housings designed to receive pavings of small contiguous precious stones with the very high precision that is necessary for this kind of application, i.e. of the order of 0.01 mm. The use of such machines further permits the removal of metal on the periphery of each housing so as to leave only claws which are thereafter deformed for setting each stone.

According to one known machining process, six claws are left on the periphery of each stone, said claws having a foot of reduced section which is permanently deformed by buckling, by pressing a setting tool on the claws.

Conventionally, the stones-setting operations are performed by hand, so that the operator can control the force applied on the setting tool in order to prevent the delicate precious or semi-precious stones from being crushed.

Hand-setting is a lengthy and costly operation and it is advantageous to mechanize it. In the case of a metal support which is flat and where the claws are deformed by a pressure perpendicular to the support, a tool shaped as a flat plate can be mounted in the tool-holder of the machine-tool, said tool resting simultaneously on all the claws and causing them to buckle up.

In the case of a curved metal support, one or more small tools can be mounted on the tool-holder of the machine, and the displacements of the table of the machine-tool are programmed so that said table presents successively all the claws under the tools and that said tools move vertically in order to buckle up the claws.

Yet there is a big problem arising with mechanical setting, which is due to the difference in the height of the stones. Indeed, it is possible, by passing the stones through series of screens, to grade them with very high precision, of the order of 0.02 mm on the diameter of the stones, but it is not possible to class them with the same precision as far as the height of the part of the stones situated above the conical seating on which they rest is concerned.

With a mechanical setting, since the vertical displacement of the setting tool is necessarily the same for all the stones, the highest stones are crushed by the claws and the mechanical setting becomes impossible.

The object of the present invention is to propose processes for the mechanized manufacture of jewelry comprising a plurality of small contiguous stones, set in a support made of precious metal, which processes permit the mechanical setting of the stones by buckling up the claws without any risk of the highest stones being crushed, and enable the external face or upper face of each of the stones to be situated inside the same plane after setting.

One of the processes according to the invention for the mechanized manufacture of jewelry comprising a plurality of small contiguous stones set in a metal support, is of the known type according to which contiguous housings are cut in the support, each housing comprising a conical seating for receiving a stone and setting claws situated on the periphery of each housing.

The object of the present invention is reached with a process which consists in machining said housings so as to only leave a seating which is narrow enough to be readily deformable, in placing a stone in each housing, applying pressure on the upper faces of the stones so that the pressure exerted on the highest stones causes the deformation of the narrow seating and that the upper faces of all the stones are situated at the same distance from the external face of the support, and in setting the stones by pressing a setting tool on said claws.

According to a preferred embodiment of the invention, a first groove, with its top directed downwardly, is machined in each seating, said groove defining a very narrow central seating.

Advantageously, a second groove is machined in each housing below the central seating, said second groove defining with the bottom of the first groove, supports for said central seating, which supports are joined to the body of the metal support by a thin web which is deformable by bending.

According to the present invention, it is possible to perform mechanically and automatically, on a programmed numerical-control machine, not only all the support-machining operations, but also the setting of small stones of different height.

With the processes according to the invention, any crushing of the stones during the mechanized-setting operation is prevented.

It is moreover possible to obtain jewelry comprising a paving of small stones in which all the upper faces of the stones, i.e. the external and visible faces, are situated at the same distance from the external face of the support, regardless of the different heights of the stones, this improving the aesthetic appearance of the jewelry, which is essential.

Although the support-machining process according to the invention is more particularly suitable for a mechanized setting, it is specified that the same process can also be used for a hand setting to prevent any crushing of the stones.

In the case of stones set in a flat support, it is possible to use a plate-shaped setting tool provided with sunk recesses in those parts corresponding to the positions of claws, such plate-shaped setting tool being first pressed over the upper faces of all the stones in order to bring these inside the same plane, regardless of the different heights of the stones, and then lowered so as to press against all the claws at the same time, with the object of buckling the claws and setting in the stones.

The invention will be more readily understood on reading the following description with reference to the accompanying drawings, in which.

Figure 1:
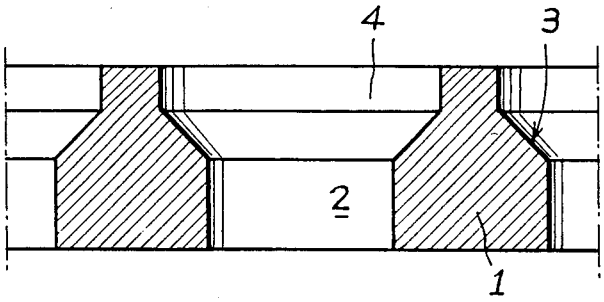
FIG. 1 is a partial vertical section of a jewelry support at the end of the first machining step of the process according to the invention.

Referring first to FIG. 1, this shows a partial vertical section of a support in precious metal 1, in which cylindrico conical contiguous housings have been machined.

Each housing comprises a conical seating 3, a lower bore 2 located under each conical seating and an upper bore 4 located about said conical seating. Each housing is adapted to receive a small precious stone, such as a brillant, which rests on the seating 3. The precious stones are graded with high precision by being passed through series of screens whose meshes have openings decreasing for example by 0.05 mm or 0.02 mm from one screen to the next. The diameter of the bores 4, substantially corresponds to the diameter of the stone, so that each stone penetrates with only a very small amount of play in its housing.

The machinings of the cylindrical bores 2 and 4 and of the conical seatings are performed mechanically on a numerical-control machine-tool.

According to one known process, rotating mills are mounted on the tool holder of the numerical control machine tool, after the machining of the contiguous cylindrico-conical bores 2,3,4, in order to remove the metal bridges separating adjacent, bores 4, leaving on the periphery of each housing, only a number of setting claws, such as six for example.

According to other known processes, the claws left on the housings periphery have a foot of reduced section so that, when pressure is applied on one claw, the foot undergoes a permanent deformation by buckling and the claws heads are brought to rest against the stone which is set in position in the bore 4.

Heretofore, the stone-setting operations have been performed by hand with a setting tool which is pressed successively on the head of each claw, the pressure being controlled so as not to crush the delicate stones.

Machining of the metal supports on numerical-control machine-tools makes it possible to program these machines so that they perform automatically all the machining operations for the housings and the claws on a support which can receive up to 60 contiguous stones per square centimeter and, once these operations have been programmed, they can be repeated a great number of times, hence a relatively low machining cost despite the very high precision which is demanded. Hand-setting on the contrary is an expensive operation and requires experts in conventional stone-setting who are nowadays difficult to find. Therefore it is a great advantage to be able to perform this operation mechanically and automatically with one or more tools mounted on the tool-holder of a numerical-control machine.

Up to now, such mechanical stone setting had proved impossible because of the different height of the parts of the stones situated above the seating, difference which can reach several tenths of a millimeter for stones of the same granulometric class.

In a mechanized setting, it is not possible to control the pressure exerted on each claw. As a result, the highest stones are compressed to excess by the claws or by the setting tool and they are crushed.

With the process according to the invention, on the contrary, it is possible to overcome this problem and to perform the setting operations mechanically without crushing the stones.

Figure 2:
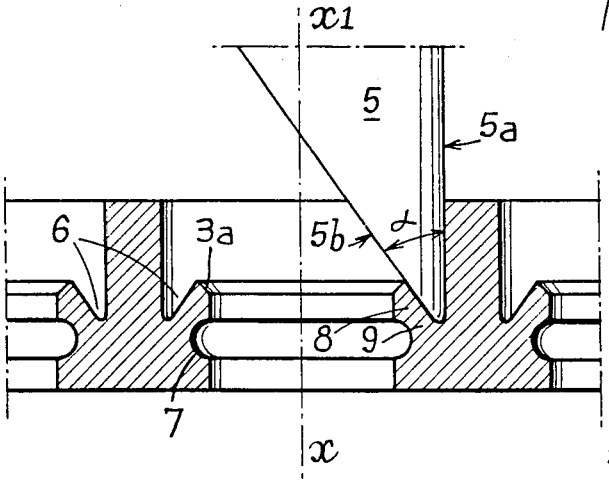
FIG. 2 is a partial vertical section of the same part at the end of the second step.

FIG. 2 illustrates the second step in a process according to the invention, during which the table of the machine-tool moves the support 1 under a milling tool 5 which is mounted on the tool-holder and which rotates about its axis x xl.

The machine positions the support 1 in such a way that the axis of each housing is aligned successively with axis x xl of the milling tool. Said milling tool 5, illustrated in FIG. 2, comprises a vertical cutting edge 5*a*. As a variant, said cutting edge may be inclined slightly outwardly starting from the top.

The milling tool 5 comprises a second cutting edge 5*b* which is inclined so as to form, with cutting edge 5*a*, an acute angle $\alpha$. The distance between the vertical cutting edge 5*a* and the axis x xl is equal to the radius of the bore 4.

As a variant, the milling tool 5 could have other shapes.

The milling tool is lowered in each bore 4 so as to cut on the outer periphery of the seating 3, a groove 6 of which the section can be, for example, triangular, and to leave a very narrow annular seating 3*a* situated along the inner and lower edge of the seating 3.

According to a preferred embodiment illustrated in FIG. 2, a second groove 7 is machined on the inner periphery of each bore 2, which second groove may have a semi-circular cross-section. Said second groove 7 is situated under the seating 3*a*. It defines with the bottom of the triangular groove 6, a ring 8 bearing the seating 3*a*. Said ring 8 is joined to the body of the support 1 by a narrow web 9 which is readily deformable by bending over inwardly.

It is specified that the machining of the second groove 7 is optional. If such a groove is not provided, the seating 3*a* on which the stone rests, is sufficiently narrow for it to crush, if pressure is applied on the stones, well before such pressure reaches the compression strength threshold of the stone.

Figure 3:
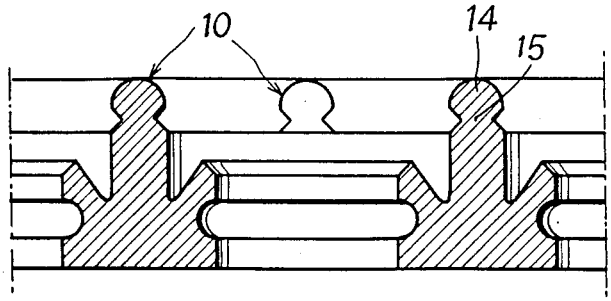
FIG. 3 is a partial vertical section taken after the third step.

FIG. 3 illustrates the next step of one process according to the invention, during which a rotating mill is mounted on the tool-holder of the machine tool in order to remove, over a predetermined height, the metal bridges between the contiguous bores 4, leaving only a few islets of metal 10, such as for example four or six islets on the periphery of each bore. Said islets constitute the claws for setting the stones.

According to a preferred embodiment illustrated in FIG. 3, the claws 10 have a round head 14 and a foot of smaller section 15, so that when a force is applied on the head of one claw, the foot is deformed by buckling.

The machining of the support 1 leading to the formation of the claws 10 is described in Applicant's French Patent Application No. 85/04350, and reference should be made to that document for details.

According to a variant, the step illustrated in FIG. 3 can precede the step illustrated in FIG. 2.

According to the embodiment illustrated in FIG. 3, the height of the claws 10 is equal to the height of the bore 4.

According to a variant, the claws 10 can be longer, reaching to the level of the bottom of groove 6. In this case, the seating 3*a* and support 8 are cut into several sections, making them more readily deformable when pressure is applied on the stones.

Figure 4:
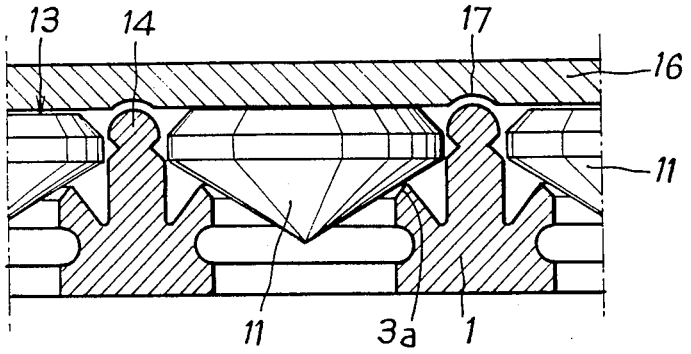
FIG. 4 is a partial vertical section of a piece of jewelry during the operation of setting the stones in their housings.

FIG. 4 shows the next step of a process according to the invention , during which a small precious or semi-precious stone 11, for example a diamond cut into a brilliant, is placed by hand in each bore 4, and is brought to rest against the seating 3a. The height of the stones above the seating varies for every stone.

After placing one stone 11 in each housing, pressure is applied on the upper face 13 of all the stones in order to press them down into their housing.

FIG. 4 illustrates one particular example in which the metal support 1 is flat. In this case, a flat plate 16 is simultaneously pressed over all the stones, which flat plate comprises on its lower face, sinking recesses 17 corresponding to the positions of the claws. The plate first rests over the upper faces 13 of the highest stones and the pressure exerted on these stones is transmitted to annular seating 3a or seating sections 3a, this causing them to deform and allowing the stones to descend into their housing. The deformation of seating 3a occurs well before the pressure exerted on the stones reaches the breaking threshold of said stones, this preventing the stones from bursting into pieces. The plate continues to go down until the upper faces of all the stones are inside the same plane. The sinking recesses 17 then press on the heads 14 of the claws 10 thus causing deformation of the claws by buckling.

In the case of a curved support, it is possible to press each stone individually into its housing, or to use a push-member having a bent surface parallel to that of the support. At the end of such pressing-in operation, the upper faces of all the stones are situated at the same distance from the external face of the support, that is from the surface passing through the top of the claws 10.

Also in the case of a curved support, setting of the claws is performed with a setting tool 12, of which one end is concave and adopts substantially the shape of the claws heads. Such tool can be mounted on the tool-holder of a numerical-control machine, the displacements of the work-table of the machine being programmed so that said table presents successively every claw under the setting tool.

If the radius of curvature of the support is long enough, it will be possible to use a setting tool with a plurality of setting heads.

It will be noted in any case that, when pressure is applied on the claws in order to deform them, said claws transmit a pressure to the stone, but the transmitted pressure is considerably less than that applied beforehand on the stones to drive them into their housing, so that there is no risk, during the setting of the claws, that seating 3a be deformed.

Figure 5:
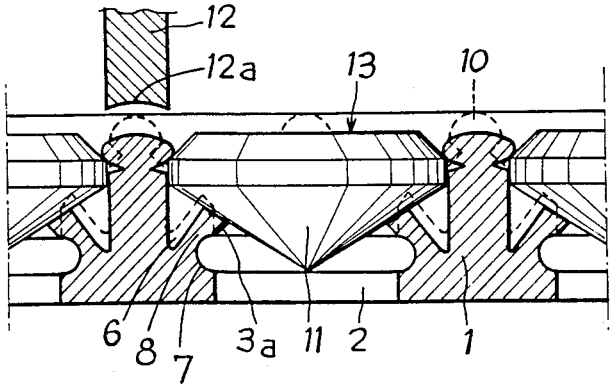
FIG. 5 is a partial vertical section of a piece of jewelry after the stone setting operations.

FIG. 5 shows, in block lines, the final position of claws 10 and of seating 3a after the setting operation, and in dotted lines, the position of the claws and of annular seating 3a before deformation.

The description given hereinabove refers to one particular example in which, in order to weaken the seating and to make it deformable, the upper outer part of said seating has been machined, so as to leave only a thin central flange 3a.

As a variant, it is also possible to machine the bores 2 and 4 in such a way that the diameter of bore 2 is very slightly less than the diameter of bore 4 and, so that the seating 3 is sufficiently narrow to be readily deformable under the pressure exerted on the stones, for example with a plate mounted on a press, this permitting the production of jewelry comprising stones of which the outer faces are all exactly inside the same plane.

What is claimed is:

1. A process for the mechanized manufacture of jewelry comprising a plurality of small contiguous stones set in a metal support having an external face which process comprises the following steps:

mounting said support on a movable table of a machine-tool;

machining in said support a plurality of contiguous cylindrico-conical housings separated from one another by metal bridges, each housing comprising an upper and a lower cylindrical bore joined together through a conical bore having an outer and an inner periphery and forming a conical seating for a stone;

machining said support with a triangular rotating milling tool mounted on the tool-holder of said machine-tool for cutting in said outer periphery of each conical seating, a triangular groove leaving a very narrow annular and conical seating situated around said inner periphery;

machining said support with a rotating tool mounted on the tool-holder of said machine tool for removing a part of the metal bridges between said contiguous upper bores and leaving a few islets of metal on the periphery of each bore, which constitute claws for setting the stones;

placing a little stone in each housing;

pushing down the upper faces of the stones with a push-member having a lower face parallel to said external face of the support until said lower face is applied simultaneously against the upper faces of all the stones so that the pressure exerted on the stones cause them to sink in by deforming said narrow annular seatings and so that the upper faces of all stones are positioned in a surface parallel to said external face of the support; and setting said stones by pressing a setting tool over said claws.

2. A process according to claim 1 further comprising a step of machining a groove, on the inner periphery of each lower bore under each annular and conical seating, which groove defines with the bottom of said triangular groove, a ring which supports said annular seating and which is joined to the body of the support by a narrow web which is inwardly deformable by bending.

3. A process according to claim 2 in which said groove in the periphery of each lower bore has a semi-circular cross-section.

4. A process for the mechanized manufacture of jewelry comprising a plurality of small contiguous stones having different heights set in a support having a flat upper face which process comprises the following steps:

placing said support on a table of a machine-tool comprising a tool-holder;

machining in said support a plurality of contiguous cylindroconical housings separated from one another by metal bridges, each housing comprising an upper and a lower cylindrical bore and a conical bore having an outer periphery joined to said upper bore and an inner periphery joined to said lower bore, which conical bore is intended to form a conical seating for a stone;

machining said support with a triangular rotating tool mounted on said tool-holder for cutting in said outer periphery of each conical seating a triangular groove leaving a very narrow annular and conical seating situated around said inner periphery;

machining said support with a rotating tool mounted on said tool-holder for removing a part of the metal bridges between said contiguous upper bores and leaving a few islets of metal on the periphery of each bore which constitute claws having a head for setting the stones;

placing on said tool-holder a plate having a plane lower face parallel to said upper face of the support and lowering down this plate over the upper faces of the stones so that said plate transmits a pressure on the stones which is transmitted by the stones to said annular and conical seatings and deform the seatings until the upper faces of all the stones are positioned in a same plane parallel to said upper face of the support.

5. A process as claimed in claim 4 wherein said lower face of said plate comprises recesses situated correspondingly to said claws and said plate is lowered down until said recesses rest on the claws heads and deform them in pressing them down.

6. A process for the mechanized manufacturing of jewelry comprising a plurality of small contiguous stones having different heights set in a metal support having an upper face which process comprises the following steps:

mounting said support on a movable table of a machine tool having a tool-holder;

machining in said support a plurality of contiguous cylindrico-conical housings each housing comprising an upper and a lower cylindrical bore and a conical bore situated between said cylindrical bores and the diameters of said lower bores are slightly less than the diameters of said upper bores so that said conical bores which constitute seatings for the stones, are sufficiently narrow to be deformable under the pressure exerted on the stones without breaking said stones when pressing on them for setting the upper faces of all the stones in a same surface parallel to said upper face of the support.

* * * * *